US007832679B2

(12) United States Patent
Denen et al.

(10) Patent No.: US 7,832,679 B2
(45) Date of Patent: Nov. 16, 2010

(54) SHEET MATERIAL DISPENSER WITH PERFORATION SENSOR AND METHOD

(75) Inventors: Dennis J. Denen, Westerville, OH (US); Joshua M. Broehl, Worthington, OH (US); John J. Knittle, Westerville, OH (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 557 days.

(21) Appl. No.: 11/686,648

(22) Filed: Mar. 15, 2007

(65) Prior Publication Data

US 2007/0152010 A1 Jul. 5, 2007

Related U.S. Application Data

(60) Division of application No. 10/881,467, filed on Jul. 1, 2004, now Pat. No. 7,191,977, which is a continuation of application No. 09/793,077, filed on Feb. 27, 2001, now Pat. No. 6,766,977.

(51) Int. Cl.
*B65H 26/06* (2006.01)

(52) U.S. Cl. ..... 242/563.2; 242/563

(58) Field of Classification Search ..... 242/563, 242/563.2, 564.4, 418, 419, 419.5; 226/181; 235/103

See application file for complete search history.

(56) References Cited

U.S. PATENT DOCUMENTS

| | | | |
|---|---|---|---|
| 1,026,128 | A | 5/1912 | Rydquist |
| 2,121,346 | A | 6/1938 | Harvey |
| 2,135,767 | A | 11/1938 | Price et al. |
| 2,193,759 | A | 3/1940 | Birr |
| 2,215,052 | A | 9/1940 | Price et al. |
| 2,957,264 | A | 10/1960 | Ruff |
| 2,957,636 | A | 10/1960 | Lesavoy |
| 3,065,889 | A | 11/1962 | Grosser |
| 3,361,021 | A | 1/1968 | Toth |
| 3,425,306 | A | 2/1969 | Wetzler |
| 3,626,491 | A | 12/1971 | Grosser |
| 3,687,397 | A | 8/1972 | Suzuki et al. |

(Continued)

FOREIGN PATENT DOCUMENTS

| | | |
|---|---|---|
| EP | 1101434 A2 | 5/2001 |

(Continued)

OTHER PUBLICATIONS

American Psychological Association (APA): contact. (n.d.). Dictionary.com Unabridged. Retrieved Jan. 19, 2010, from Dictionary.com website: http://dictionary.reference.com/browse/contact.*

*Primary Examiner*—Evan H Langdon
(74) *Attorney, Agent, or Firm*—Joel T. Charlton

(57) ABSTRACT

A dispenser for dispensing sheet material including a plurality of spaced perforations may include a housing defining an interior for accommodating a source of the sheet material, and an outlet through which the sheet material may be dispensed. The device may also include a perforation sensor configured to sense perforations in the sheet material, disposed in the interior of the housing. The perforation sensor may include at least one light receptor, and at least a portion of the perforation sensor may be positioned in the housing to contact sheet material traveling from the source to the outlet, thereby spreading perforations in the sheet material.

3 Claims, 8 Drawing Sheets

U.S. PATENT DOCUMENTS 3,730,409 A 5/1973 Ratti
3,741,663 A 6/1973 Nevins
3,951,485 A 4/1976 Schnyder et al.
4,137,805 A 2/1979 DeLuca et al.
4,142,431 A 3/1979 Jespersen
4,165,138 A 8/1979 Hedge et al.
4,186,633 A 2/1980 Baumann et al.
4,188,844 A 2/1980 DeLuca
4,189,077 A 2/1980 Hartbauer et al.
4,192,442 A 3/1980 Bastian et al.
4,206,858 A 6/1980 DeLuca et al.
4,213,363 A 7/1980 Granger
4,307,638 A 12/1981 DeLuca et al.
4,307,639 A 12/1981 DeLuca
4,358,169 A 11/1982 Filipowicz et al.
4,378,912 A 4/1983 Perrin et al.
4,403,748 A 9/1983 Cornell
4,404,880 A 9/1983 DeLuca
4,441,392 A 4/1984 DeLuca
4,552,315 A 11/1985 Granger
4,569,467 A 2/1986 Kaminstein
4,635,837 A 1/1987 Granger
4,664,304 A 5/1987 Wendt et al.
4,666,099 A 5/1987 Hoffman et al.
4,699,304 A 10/1987 Voss et al.
4,712,461 A 12/1987 Rasmussen
4,716,799 A * 1/1988 Hartmann ..... 83/42
4,732,306 A 3/1988 Jesperson
4,738,176 A * 4/1988 Cassia ..... 83/208
4,786,005 A 11/1988 Hoffman et al.
4,834,309 A 5/1989 Raymond
4,984,530 A 1/1991 Dutton
5,048,386 A 9/1991 DeLuca et al.
5,078,033 A 1/1992 Formon
5,107,734 A 4/1992 Armbruster
5,135,179 A 8/1992 Morano
5,161,723 A 11/1992 Wirtz-Odenthal
5,244,161 A 9/1993 Wirtz-Odenthal
5,257,711 A 11/1993 Wirtz-Odenthal
5,441,189 A 8/1995 Formon et al.
5,452,832 A 9/1995 Niada
5,573,318 A 11/1996 Arabian et al.
5,772,291 A 6/1998 Byrd et al.
5,833,104 A * 11/1998 Horniak et al. ..... 225/106
5,868,343 A 2/1999 Granger
5,873,542 A 2/1999 Perrin et al.
5,915,645 A 6/1999 Granger
5,924,617 A 7/1999 LaCount et al.
5,937,718 A 8/1999 Granger
6,412,679 B2 7/2002 Formon et al.
6,578,790 B1 6/2003 Campagna
6,766,977 B2 * 7/2004 Denen et al. ..... 242/563
6,854,684 B2 * 2/2005 Byrd et al. ..... 242/563
7,114,677 B2 * 10/2006 Formon et al. ..... 242/564.3
7,191,977 B2 3/2007 Denen et al.
7,237,744 B2 * 7/2007 Morris et al. ..... 242/560.1
7,296,765 B2 * 11/2007 Rodrian ..... 242/563.2
2002/0030061 A1 * 3/2002 Formon ..... 221/13
2003/0019971 A1 * 1/2003 Lewis et al. ..... 242/564.4
2005/0051005 A1 * 3/2005 Broehl ..... 83/13
2006/0138274 A1 * 6/2006 Goeking et al. ..... 242/564.4
2007/0080255 A1 * 4/2007 Witt et al. ..... 242/563.2
2007/0152010 A1 * 7/2007 Denen et al. ..... 225/10
2009/0026305 A1 * 1/2009 Elliott et al. ..... 242/563.2

FOREIGN PATENT DOCUMENTS

WO 9959457 A1 11/1999

* cited by examiner

SHEET MATERIAL DISPENSER WITH PERFORATION SENSOR AND METHOD

CROSS REFERENCE TO RELATED APPLICATIONS

This application is a division of U.S. application Ser. No. 10/881,467, filed Jul. 1, 2004, which is a continuation of U.S. application Ser. No. 09/793,077, filed Feb. 27, 2001, now U.S. Pat. No. 6,766,977. The priorities of the foregoing applications are hereby claimed and the entirety of their disclosures incorporated herein by reference.

FIELD OF THE INVENTION

The present invention relates to sheet material dispensers in general. More particularly, the present invention relates to sheet material dispensers capable of dispensing individual sheets from a roll of sheet material. The individual sheets are defined by rows of perforations in the sheet material.

BACKGROUND OF THE INVENTION

Sheet material dispensers are designed to dispense individual sheet material from various sources including folded sheet material and rolled sheet material. Each type of sheet material source requires a different means of dispensing the sheet material. As a result, each source has unique problems in controlling how much sheet material is dispensed, and how quickly more sheet material is made available.

Folded sheet material dispensers contain separate sheets of folded sheet material that are dispensed through an opening. When a user removes a single sheet from the opening, another individual sheet is instantly made available. As a result, several sheets can be removed at once. Because the sheets are so readily available, there is no real limit to how many sheets can be removed by the user. Therefore, folded sheet material dispensers must by constantly checked to make sure they are full.

One common type of sheet dispenser dispenses sheet material wound on rolls. These dispensers have several different means of dispensing paper. The sheets can be removed by either pulling on a free end of a sheet or actuating a lever to advance the sheet. These dispensers usually have a cutter to sever the individual sheet from the source of sheet material. The cutter can be arranged adjacent to the opening, in which case the user removing the sheet must force the sheet against the cutter. Otherwise, the cutter is formed as part of a cutting drum mechanism.

The most simple dispensers rely on the user to pull on a free end of sheet material, thereby causing the sheet material to be dispensed. The amount of force necessary to dispense the sheet material depends in part on the location of the cutter. It takes more force to remove an individual sheet where the cutter is part of a cutting drum mechanism as compared to when the cutter is located adjacent to the opening. When the cutter is part of the cutting drum mechanism, it is the rotational momentum of the cutting drum that severs the individual sheet from the sheet material roll. To obtain the required amount of rotational momentum, the user has to apply more force than simply pulling the sheet material against the cutter.

Due to relatively recent advances in paper making technology that permit relatively easy formation of perforations in sheet material, there are now a number of dispensers capable of dispensing sheet material having spaced rows of preformed perforations. Such perforations weaken the sheet material, making it easier to separate an individual sheet from the remainder of sheet material. Some conventional dispensers for this type of sheet material have drawbacks and disadvantages. For example, these dispensers are designed so that after an individual sheet is dispensed, a sufficient length (tail end) of sheet material normally remains extended from the dispensing outlet to be grasped by the next user. Sometimes, however, when the sheet material tears along a perforation line positioned inside the dispenser, there is little or no exposed length of sheet material that can be grasped. In some cases, this requires the next user to actuate a manual lever or crank that could spread germs or other contaminants from one user to another.

The present inventors have proposed to improve sheet material dispensing by providing a sheet material dispenser with perforation detecting capability, for example. Such detection, however, is challenging because the translucence of the some types of sheet material may provide false indications of perforations.

In light of the foregoing, there is a need in the art for an improved dispenser and method for dispensing sheet material.

SUMMARY OF THE INVENTION

Accordingly, the present invention is directed to a dispenser for dispensing sheet material and a method of dispensing that substantially obviate one or more limitations of the related art. In one advantageous aspect, the present invention facilitates dispensing of individual sheets from a source of sheet material having a plurality of spaced perforations.

To achieve these and other advantages and in accordance with the purpose of the invention, as embodied and broadly described herein, the invention includes a dispenser for dispensing sheet material including a plurality of spaced perforations. The dispenser includes a housing defining an interior for accommodating a source of the sheet material, and an outlet through which the sheet material is dispensed. A perforation sensor is configured to sense perforations in the sheet material, and this perforation sensor is disposed in the interior of the housing. The perforation sensor includes at least one light receptor, and at least a portion of the perforation sensor is positioned in the housing to contact sheet material traveling from the source to the outlet, thereby spreading perforations in the sheet material.

In another aspect, the portion of the perforation sensor is a light emitter configured to emit light capable of being detected by the light receptor. The light emitter and the light receptor are spaced apart from one another such that the sheet material can be positioned between the light emitter and light receptor. This allows light to pass from the emitter to the receptor via the perforations, where the spreading of the perforations increases the amount of light passing through the perforations.

In yet another aspect, the sheet material is dispensed in a first direction. The perforation sensor is located in the housing such that the portion of the perforation sensor contacts the approximate middle of the sheet material in a second direction perpendicular to said first direction.

In another aspect, the dispenser further includes at least one rotatable roller in the housing. At least a portion of the sheet material is in contact with the roller when the sheet material travels from the source to the outlet.

In a further aspect, the roller includes at least two spaced sections and the portion of the perforation sensor is positioned between the roller sections to contact sheet material on the rollers.

In an additional aspect, the dispenser includes a brake configured to brake rotational movement of the roller and a controller for controlling the brake. The controller is in electrical communication with the perforation sensor.

In yet another aspect, the brake includes a detent member coupled to the roller, and a solenoid mounted to the housing. The detent member has a plurality of detents provided thereon, the solenoid has a plunger configured to selectively engage a respective one of the detents.

In another aspect, there are two light receptors. The perforation sensor also includes a differential trans-impedance amplifier for detecting light incident upon the two light receptors.

In a further aspect the differential trans-impedance amplifier is configured as a balanced bridge for amplifying the difference in intensity of light detected by the two light receptors.

In an additional aspect the differential trans-impedance amplifier includes a first operational amplifier, a second operational amplifier, a feed back resistor, a scaling resistor, and a gain resistor. The first operational amplifier has an inverting input node, a non-inverting input node, and an output node. The second operational amplifier has an inverting input node, a non-inverting input node, and an output node. The feedback resistor has a first end and a second end, wherein the first end is electrically coupled to the inverting input node of the first operational amplifier. The scaling resistor has a first end and a second end. The first end of the scaling resistor is electrically coupled to the second end of the feedback resistor and the second end of the scaling resistor is electrically coupled to the inverting input node of the second operational amplifier. The gain resistor has a first end and a second end. The first end of the gain resistor is electrically coupled to the inverting input node of the second operational amplifier and the second end of the gain resistor is electrically coupled to the output node of the second operational amplifier.

In another aspect of the present invention, the dispenser includes a housing defining an interior for accommodating a source of the sheet material, and an outlet through which the sheet material is dispensed. A perforation sensor is configured to sense perforations in the sheet material. The perforation sensor is disposed in the interior of the housing. The perforation sensor includes a pair of light receptors which are aligned in substantially the direction of sheet material travel from the source to the outlet. The pair of light receptors are arranged such that one of the receptors receives light passing through one of the perforations before the other receptor.

In another aspect, the perforation sensor includes a light emitter spaced from the pair of receptors such that the sheet material passes between the light emitter and the pair of light receptors during travel of the sheet material to the outlet.

In yet another aspect, the sheet material includes lines of the perforations defining individual sheets. The receptors are arranged such that the receptors are aligned along an axis substantially perpendicular to lines of perforations on the sheet material traveling adjacent to the receptors.

In another aspect, the dispenser includes a controller. The controller compares the amount of light detected by each light receptor.

In yet another aspect of the invention, the dispenser includes a housing defining an interior for accommodating a source of the sheet material, and an outlet through which the sheet material is dispensed. A perforation sensor is disposed in the interior of the housing. The perforation sensor is configured to sense perforations in the sheet material and includes at least one light receptor and a light emitter. The light receptor and the light emitter are spaced apart from one another such that the sheet material travels between the light emitter and light receptor. This allows light to pass from the emitter to the receptor via the perforations.

In another aspect, the dispenser includes a first rotatable roller in the housing. The first roller includes at least two spaced roller sections, where at least a portion of the sheet material is in contact with the first roller when the sheet material travels from the source to the outlet. Either the light receptor or the light emitter is positioned between the roller sections.

In an additional aspect, the dispenser includes a second rotatable roller in the housing, the first and second rollers defining a nip for the sheet material.

In another aspect, the dispenser includes a controller in said housing. The controller selectively activates the perforation sensor.

In an additional aspect, the dispenser further includes at least one rotatable roller in the housing. At least a portion of the sheet material is in contact with the roller when the sheet material travels from the source to the outlet. A rotation monitor is configured to monitor rotation of the roller. The controller is in electrical communication with the rotation monitor and activates the perforation sensor when the monitor detects a first predetermined amount of rotation of the roller.

In an even further aspect, the dispenser includes a brake configured to brake rotational movement of the roller, where the controller selectively activates the brake.

In an additional aspect, the controller is configured to activate the brake when the perforation sensor senses a perforation in the sheet material.

In another aspect of the present invention, the dispenser includes a housing defining an interior for accommodating a source of the sheet material, and an outlet through which the sheet material is dispensed. At least one rotatable roller in the housing, and at least a portion of the sheet material being in contact with the first roller when the sheet material travels from the source to the outlet. The dispenser also includes a rotation monitor configured to monitor the amount of rotation of the roller to thereby determine the amount of sheet material traveling downstream from the roller.

In yet another aspect, the present invention includes a method of dispensing sheet material. The method includes providing a dispenser containing a source of sheet material including a plurality of spaced perforations. The dispenser includes a perforation sensor including at least one light receptor and a light emitter, at least one rotatable roller, a brake configured to selectively brake rotation of the roller, and an outlet for dispensing sheet material. The method includes passing sheet material from the source to the outlet wherein the sheet material contacts the roller and the roller rotates. The sheet material passes between the light receptor and the light emitter. The method includes detecting a perforation in the sheet material by sensing an increased amount of light reaching said light receptor from said light emitter. The method includes activating the brake to cause tension in the sheet material when an end portion of the sheet material is pulled.

In another aspect, the method includes monitoring the amount of rotation of the roller and activating the perforation sensor when the roller rotates a first predetermined amount.

In an additional aspect, the method includes activating the brake when the perforation sensor detects a perforation and the roller rotates a second predetermined amount.

In another aspect, the brake includes a detent member and a solenoid having an arm configured to selectively engage the detent member when the solenoid is activated. The method includes activating the solenoid.

In yet another aspect, the present invention includes a method of dispensing sheet material. The method includes providing a dispenser for containing a source of sheet material including a plurality of spaced perforations. The dispenser includes at least one rotatable roller, a rotation monitor configured to monitor the amount of rotation of the roller to thereby determine the amount of sheet material traveling downstream from the roller, a brake configured to selectively brake rotation of the roller, and an outlet for dispensing sheet material. The method includes passing sheet material from the source to the outlet, wherein the sheet material contacts the roller and the roller rotates. The method includes monitoring the amount of rotation of the roller to thereby determine the amount of sheet material dispensed. The method includes activating the brake when a predetermined amount of sheet material is dispensed, said activation causing tension in the sheet material when an end portion of the sheet material is pulled.

In another aspect, the dispenser further includes a perforation sensor including at least one light receptor and a light emitter. The method further includes detecting an initial rotation of the roller. The perforation sensor is activated when the roller rotates a first predetermined amount of rotation. The brake is activated when at least one of the perforation sensor detects a perforation and the roller rotates a second predetermined amount.

In yet another aspect, the present invention includes a method of dispensing individual sheets from a dispenser containing a source of sheet material having a plurality of spaced perforations. The dispenser includes at least one rotatable roller, a rotation monitor configured to monitor the amount of rotation of the roller to thereby determine the amount of sheet material traveling downstream from the roller, a perforation sensor for sensing perforations in the sheet material, and an outlet for dispensing sheet material. The method includes detecting the amount of rotation of the roller, and sensing a perforation in the sheet material. In response to detection of said perforation, the method includes stopping the advancing of the sheet material when the roller rotates a first predetermined amount.

In a further aspect, the method includes detecting an initial rotation of the roller.

In an additional aspect, the method includes activating the perforation sensor after a second predetermined amount of rotation of the roller.

In yet another aspect, in a response to no perforation being detected when the roller rotates a third predetermined amount, the method includes stopping the advancing of the sheet material.

In an additional aspect, the dispenser includes a brake configured to selectively brake rotation of the roller, and wherein the stopping of sheet material advancing includes activating the brake.

Additional aspects of the invention will be set forth in part in the description which follows, and in part will be obvious from the description, or may be learned by practice of the invention. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments of the invention and together with the description, serve to explain the principles of the invention. In the drawings.

DESCRIPTION OF THE PREFERRED EMBODIMENTS

Figure 1A:
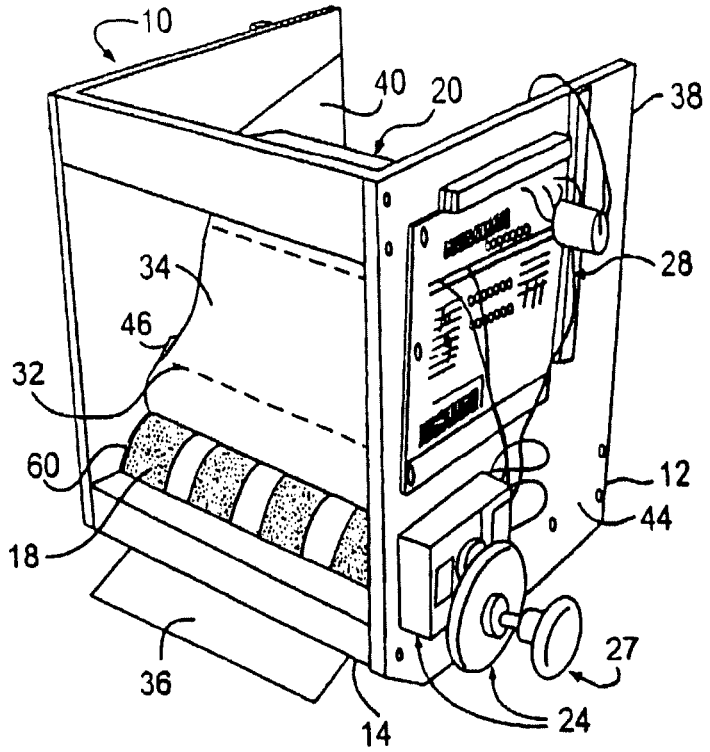
FIG. 1A is a right, front, isometric view of an embodiment of a dispenser according to the present invention with a roll of sheet material loaded.

Reference will now be made in detail to the present exemplary embodiments of the invention, examples of which are illustrated in the accompanying drawings. Wherever possible, the same reference numbers will be used throughout the drawings to refer to the same or like parts.

FIGS. 1-5 show an embodiment of the sheet dispenser 10. The dispenser 10 includes a housing 12 including an outlet 14 and a cover (not shown). Disposed within the housing 12 are a nib roller 16, a dispensing roller 18, a sheet material source 20, a paper guard 23, and a perforation sensor 22. Attached to the dispensing roller 18 is a brake assembly 24. A rotational monitor 26 is shown attached to the dispensing roller 18, although the rotational monitor 26 could be attached to the nib roller 16. The perforation sensor 22, brake assembly 24, and rotational monitor 26 are in electrical communication with a controller 28. The controller 28 can be any suitable controller, such as microchip PI C 12C508 obtained from Microchip Technology, Inc., located at 2355 West Chandler Boulevard, Chandler, Ariz.

In the preferred embodiment, the sheet material source 20 is a roll of sheet material 21 wound on a core 30. The sheet material 21 can be paper towel, toilet paper, tissue paper, wrapping paper, or any other sheet material. In this embodiment, the sheet material 21 includes spaced apart zones of weakness, such as perforations 32, that permit tearing off of individual sheets 34 when they are dispensed. The perforations are preferably arranged in spaced rows. In each row, the perforations 32 could have substantially the same size, or the perforations 32 closer to the middle of the sheet material 21 could be larger than the perforations 32 at the edges of the sheet material 21. There are also many other ways the perforations could be arranged. As shown in FIG. 1A, a tail end 36, of the sheet material extends from the outlet 14.

The sheet material source 20 is rotatably supported in an upper portion 38 of the housing 12 on a pair of spaced support members 40, 42. The housing 12 could be configured to accommodate additional sheet material sources. For example, the lower portion 44 could be configured to accommodate a partially used source, such as a stub roll.

Figure 1B:
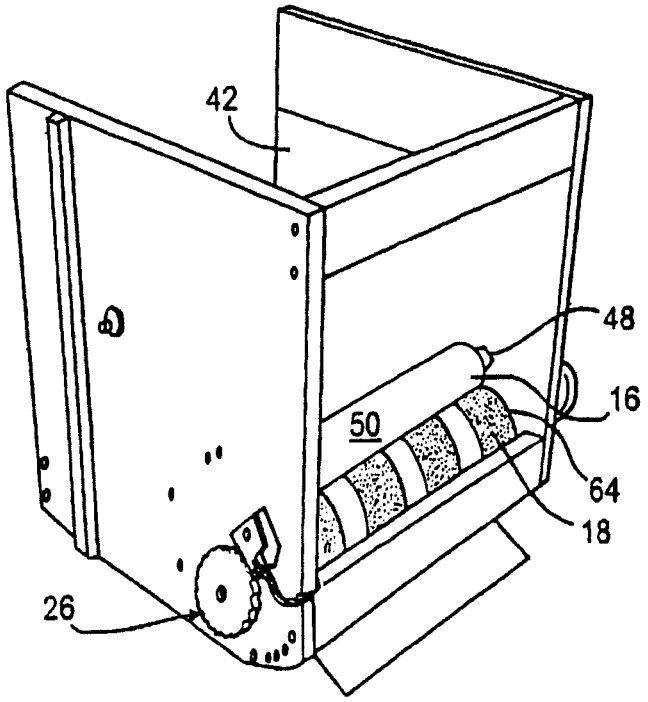
FIG. 1B is a left isometric view of the dispenser of FIG. 1A with the roll of sheet material removed.
Figure 2:
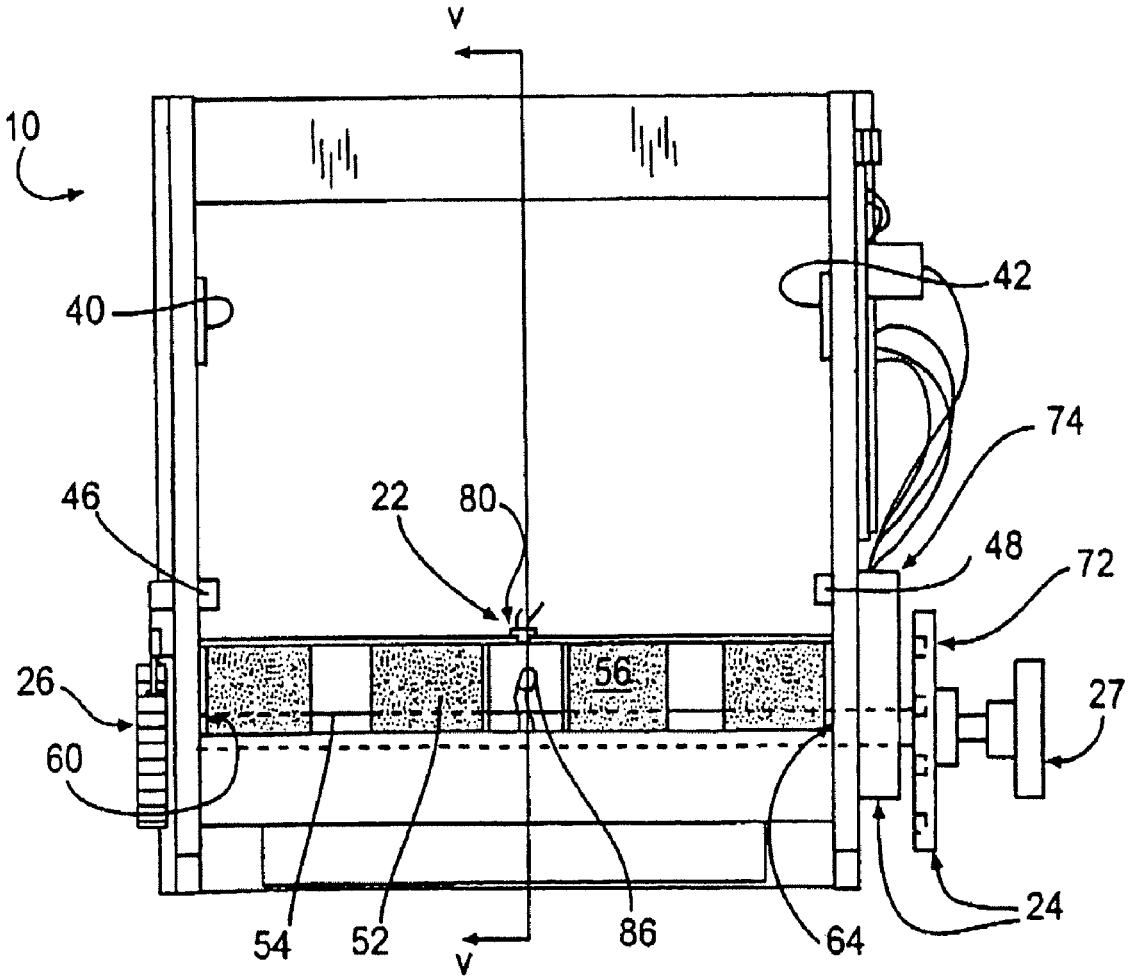
FIG. 2 is a front view of the dispenser of FIG. 1B.

As shown in FIG. 1B, the nib roller 16 is arranged adjacent the dispensing roller 18 so that the nib roller 16 and dispensing roller 18 form a nip for the sheet material. The nib roller 16 can be formed as a single roller as shown, or as a plurality of separate roller sections (not shown). The surface 50 of the nib roller 16 preferably has a high coefficient of friction. The nib roller 16 is rotatably supported by a pair of support members 46, 48, as shown in FIG. 2. During dispensing, the sheet material 21 contacts the surface 50 causing the nib roller 16 to rotate.

The dispensing roller 18, as shown in FIG. 2, is formed from a plurality of roller sections 52 arranged on a shaft 54. Adjacent roller sections are spaced from one another. The roller sections 52 and shaft 54 share a common axis of rotation. Each roller section 52 has a surface 56 preferably having a high coefficient of friction. The shaft 54 has a first end 58 supported by an optional support member 60, and a second end 62 supported by an optional support member 64. In the preferred embodiment, each end 58, 62 extends through the respective support member 60, 64 and housing 12. The first end 58 is coupled to the rotational monitor 26, and the second end 62 is coupled to the brake assembly 24. The sheet material 21 contacts the surface 56 and causes the dispensing roller 18 to rotate during dispensing. An optional manual rotating knob 27 can be coupled to the second end 62 of the shaft 54. Rotation of the knob 27 rotates the dispensing roller 18 to dispense the sheet material in the event that a tail end 36 of the sheet material 21 is not extending a sufficient distance outside of the outlet 14. The rotating knob 27 could also be used when a paper jam occurs.

Figure 3:
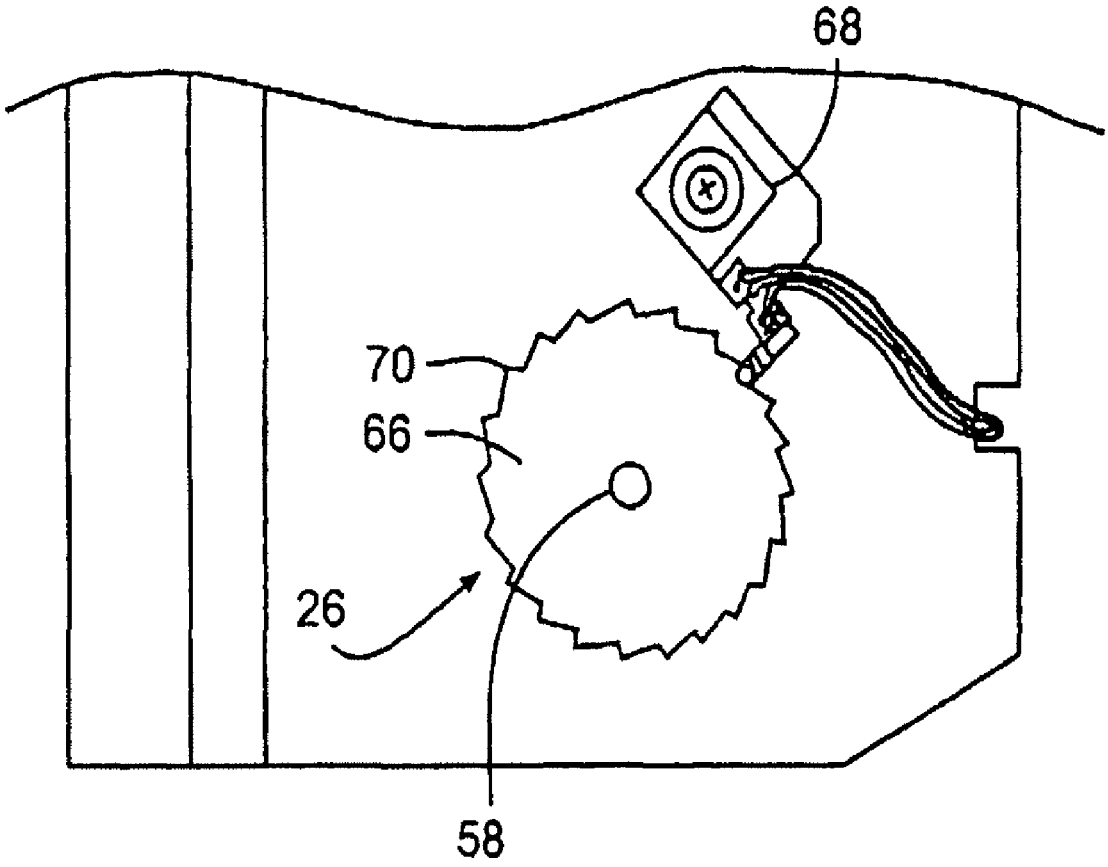
FIG. 3 is a portion of a left side view of the dispenser of FIG. 2.

In the preferred embodiment, as shown in FIG. 3, the rotational monitor 26 includes a counting wheel 66 and a counter 68. The counting wheel 66 is affixed to the first end 58 of the shaft, and includes a plurality of cut-outs 70. The adjacent cut-outs 70 are spaced equally apart from each other in a circumferential manner along the outer surface of the wheel 66, the cut-outs representing known angles of rotation. The counter 68 engages a single cut-out at any one time. When sheet material is dispensed, the sheet material causes the dispensing roller 18 to rotate and this rotation causes the counter wheel 66 to rotate a corresponding amount. The rotation of the counter wheel 66 triggers the counter 68 to send signals to the controller 28. In the preferred embodiment, each count represents 0.25 inch amount of sheet material 21 being advanced through the dispenser 10 toward the outlet 14.

Although the rotational monitor described above includes a counting wheel and counter, other suitable rotational monitors could be used. In addition, one of ordinary skill in the art should recognize that the nib roller and/or dispenser roller could be eliminated. Accordingly, certain aspects of the invention could be practiced without including these elements and also without using any type of rotational monitoring structure.

Figure 4:
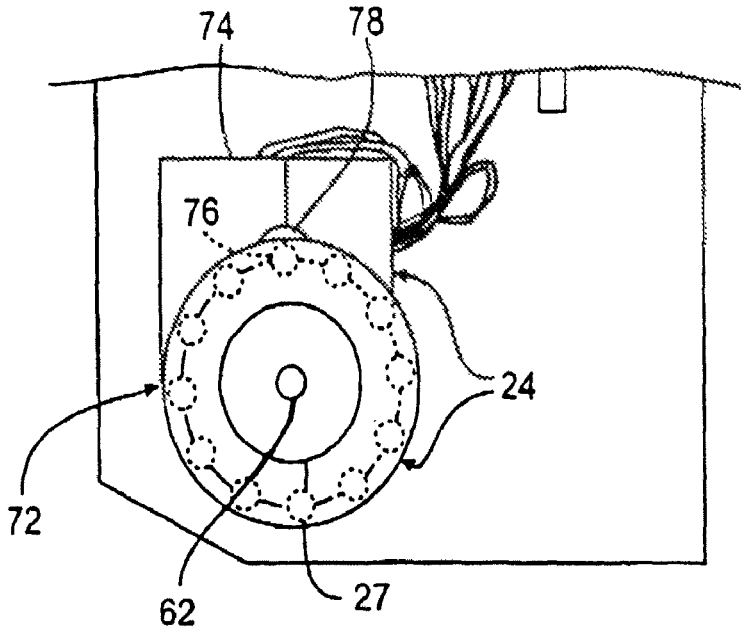
FIG. 4 is a portion of a right side view of the dispenser of FIG. 2.

On the second end 62 of the shaft 54, as shown in FIG. 4, is located the brake assembly 24. The brake assembly 24 includes a brake wheel 72 configured to rotate along with the shaft 54, and a solenoid 74. The brake wheel 72 is affixed to the second end 62, and includes a plurality of detents 76. The solenoid 74 includes a plunger 78, which is sized to engage a respective one of the detents 76 to selectively brake rotation of the dispensing roller 18. As seen in FIG. 2, the solenoid 74 is arranged between the housing 12 and the brake wheel 72, and the shaft 54 extends through the solenoid 74. In the preferred embodiment, the solenoid 74 is a latching solenoid, configured so that the plunger 78 extends into one of detents 76 only when a current energizes the solenoid. This braking arrangement is advantageous because it allows the dispenser to conserve electrical power, however, there are many other types of braking structures that could also be used.

Figure 5:
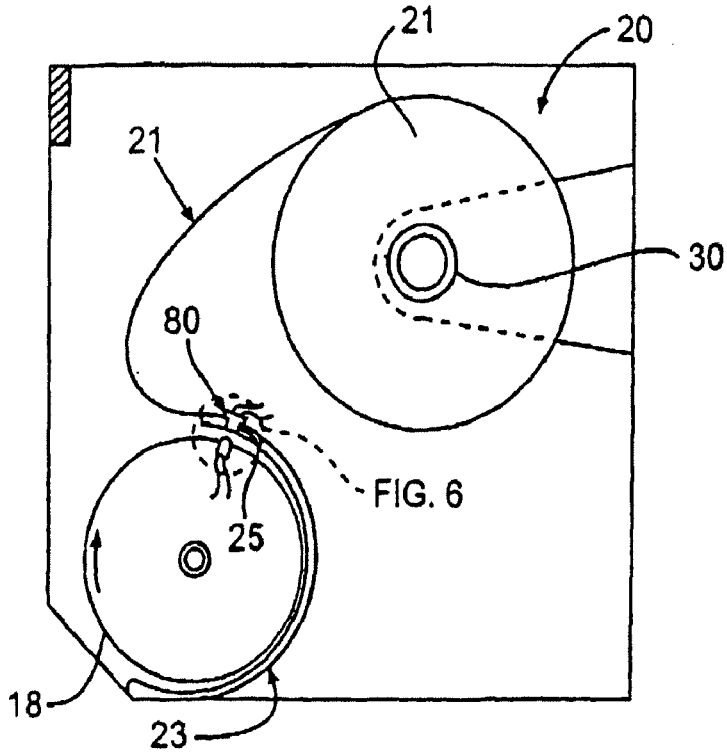
FIG. 5 is a schematic cross-section view taken along the line V-V of FIG. 2.
Figure 6:
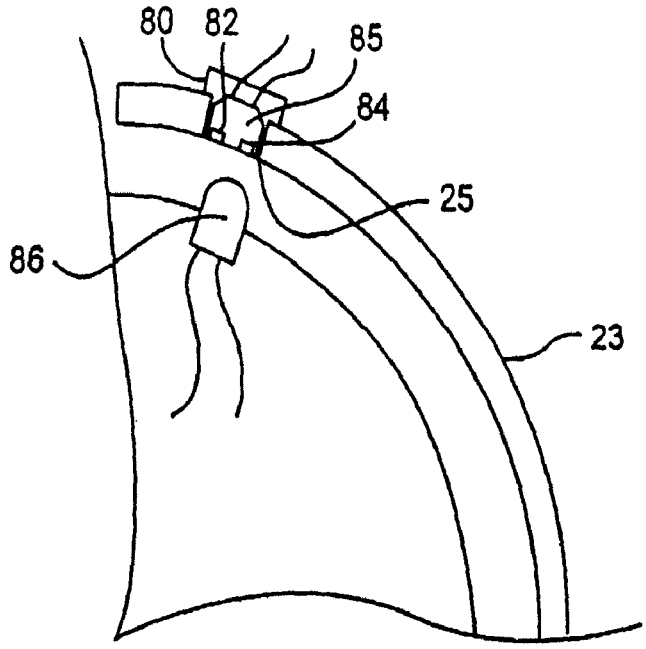
FIG. 6 is a close up view of a perforation sensor shown in FIG. 5.

As shown in FIGS. 5 and 6, the perforation sensor 22 includes a receptor housing 80 that contains a dual detector 85, and a light emitter 86 opposite the dual detector 85. The dual detector 85 includes a pair of light receptors 82, 84. The light emitter 86 is a red light emitting diode (LED), although any other suitable light source could be used. The receptor housing 80 is oriented so that the light receptors 82, 84 are substantially parallel to a surface of the sheet material 21 as the sheet material is being dispensed. The perforation sensor 22 is preferably arranged to be in the approximate middle of the sheet material 21 (along the width of the sheet material) as the sheet material is being dispensed, although the sensor 22 could be arranged along an edge of the sheet material 21.

In the preferred embodiment, the receptor housing 80 passes through an opening 25 in the paper guard 23 that allows the dual detector 85 to be placed above the light emitter 86. The paper guard 23 is located behind the dispensing roller 18 to maintain sheet material 21 in contact with the dispensing roller 18

In the preferred embodiment, the light emitter diode 86 is arranged in the space between two roller sections 52 of the dispensing roller 18, and approximately 5 mm away from the light receptors 82, 84. In addition, the light emitter diode 86 (or some other portion of the perforation sensor) is positioned in the dispenser so that it contacts sheet material traveling from the source to the outlet and thereby spreads perforations in the sheet material, especially when the sheet material is placed in tension, such as by pulling the sheet material during dispensing.

Figure 7:
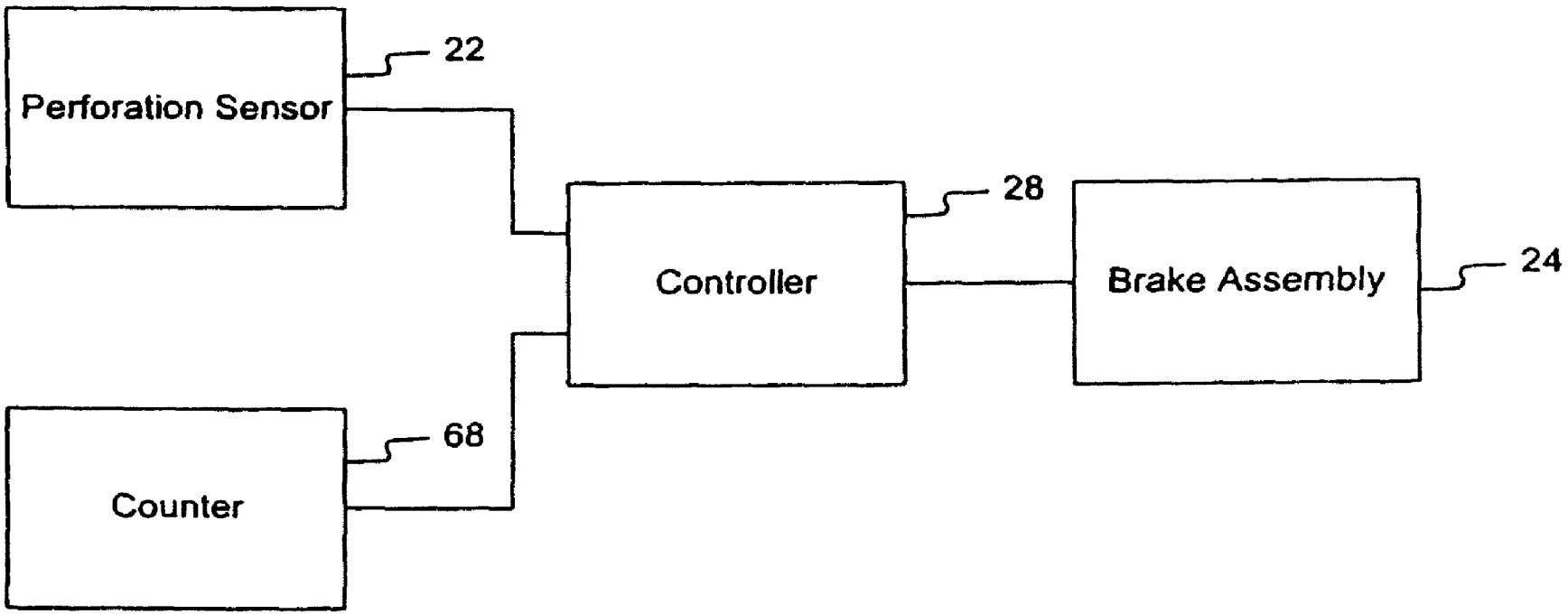
FIG. 7 is a schematic of the electrical circuit arrangement of the dispenser of FIG. 1A.

FIG. 7 depicts a block schematic diagram of the electrical control circuits for the dispenser embodiment of FIG. 1A. Perforation sensor 22 detects perforations in sheet material. Counter 68 is used to determine the amount the dispensing roller 18 rotates when sheet material passes through the dispenser outlet. Controller 28 receives input information from perforation sensor 22 and counter 68 and outputs control information to the brake assembly 24. Controller 28 also receives information from the brake assembly 24, such as data indicating completion of an operation, for example. One skilled in the art will appreciate that FIG. 7 is merely a block schematic diagram and other components may be connected without departing from the invention. In addition, error signals and other control information may be exchanged among the various components depicted in FIG. 7 to ensure or improve fault tolerance.

Figure 8:
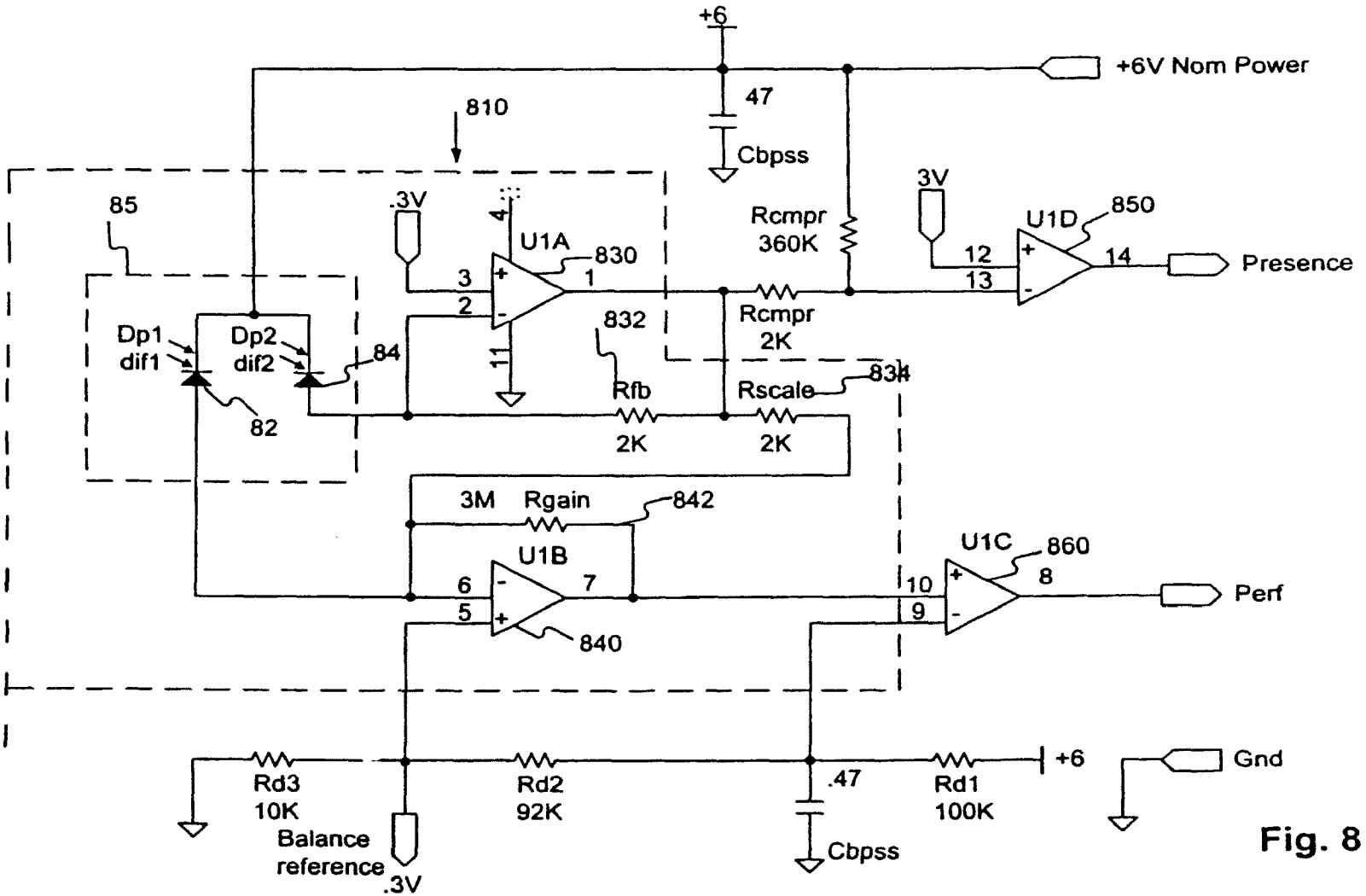
FIG. 8 is a schematic of the perforation sensor of FIG. 7.

FIG. 8 depicts one embodiment of a perforation sensor 22 that could be used for the present invention. According to this implementation, the perforation sensor includes a differential transimpedance amplifier 810 and associated components for detecting the presence of sheet material and perforations in the sheet material. Differential transimpedance amplifier 810 comprises the dual detector 85, two operational amplifiers 830 and 840, where each operational amplifier is configured as a transimpedance amplifier by providing a negative feedback path, two comparators 850 and 860, and associated components.

The two light receptors 82 and 84 of detector 85 could be photodiodes. One may use a conventional Centro CD-25T dual detector available from Centrovision, for example. The Centro CD 25T provides a substantially close match to the shape of a perforation. Light receptors 82 and 84 are preferably spaced apart in the direction of sheet material travel by a predetermined distance, such as about 0.02 mm, for example, so that the light receptors are arranged to detect a difference in light caused by a perforation passing by one of the receptors.

Dual detector 85 is arranged such that the differential bridge formed by two transimpedance amplifiers 830 and 840 is balanced. A tiny amount of current is generated even when sheet material is blocking the light from a light emitter. This is because sheet material is translucent and at least some light falls on light receptor 82, for example, causing it to permit a flow of current. This current flows across resistor $R_{gain}$ 842, where first end of the gain resistor is coupled to inverting input node of amplifier 840 and the second end of the gain resistor is coupled to output node of amplifier 840, and results in an application of voltage at the output node of transimpedance amplifier 840.

Transimpedance amplifier 830 also includes a feedback resistor $R_{fb}$ 832, where one end of the feedback resistor is connected to inverting input node of the amplifier. The voltage generated across $R_{fb}$ is further scaled by another resistor $R_{scale}$ 834, where one end of the scaling resistor is connected to the second end of feedback resistor $R_{fb}$ 832 and the other end is connected to the inverting input node of amplifier 830. Because the output of transimpedance amplifier 830 is inverted with respect to the output of the other photocurrent, the voltages substantially cancel each other out. By mechanically positioning the dual detector one can balance the bridge, such that the two voltages cancel each other out substantially. Preferably, the balance is obtained by mechanically positioning the light emitter 86 such that substantially equal amounts of light fall on both light receptors 82 and 84 when sheet material is not positioned between the light emitter 86 and the pair of light receptors 82 and 84. In this embodiment, an electrical adjustment is preferably avoided. One skilled in the art will appreciate that the differential transimpedance amplifier may be balanced using a variable $R_{balance}$ resistor, instead of using the fixed value resistors $R_{fb}$ and $R_{scale}$ and mechanically balancing the bridge.

As mentioned earlier, comparators 850 and 860 are used to generate logic signals, which are processed by controller 28, based on the output of transimpedance amplifiers 830 and 840, respectively. In the embodiment shown in FIG. 8, comparator 850 has a reference voltage of 0.3V applied to its positive node. Output of transimpedance amplifier 830 is applied to the inverting node of comparator 850. Comparator 850 is used to sense the presence or absence of sheet material. For example, presence of greater than 20 μA of photocurrent indicates absence of sheet material.

Comparator 860 is used to generate a signal when the differential bridge formed by the two transimpedance amplifiers is unbalanced. One skilled in the art will appreciate that a single light receptor, such as a photodiode may be used to detect presence of light caused by a perforation. The disclosed preferred embodiment, however, uses two light receptors. This is because translucent sheet material, such as paper towels, may have variation in thickness and other irregularities, which may cause a single detector to erroneously signal presence of a perforation. To accommodate sheet material having some degree of variation, the present invention preferably uses a balanced bridge including two light receptors. Accordingly, if an irregularity in sheet material causes more light to fall on both light receptors, the bridge stays balanced and no spurious detection signal is generated, in particular when the light receptors are spaced apart by a predetermined distance. In addition, the preferred embodiment preferably permits use of different types of sheet material, for example sheet materials with different web strengths without adjusting the perforation sensor and associated components.

One skilled in the art will appreciate that other components may be added to the circuit shown in FIG. 8. For example, capacitors may be added in parallel to feedback resistors of transimpedance amplifiers to reduce noise.

Figure 9:
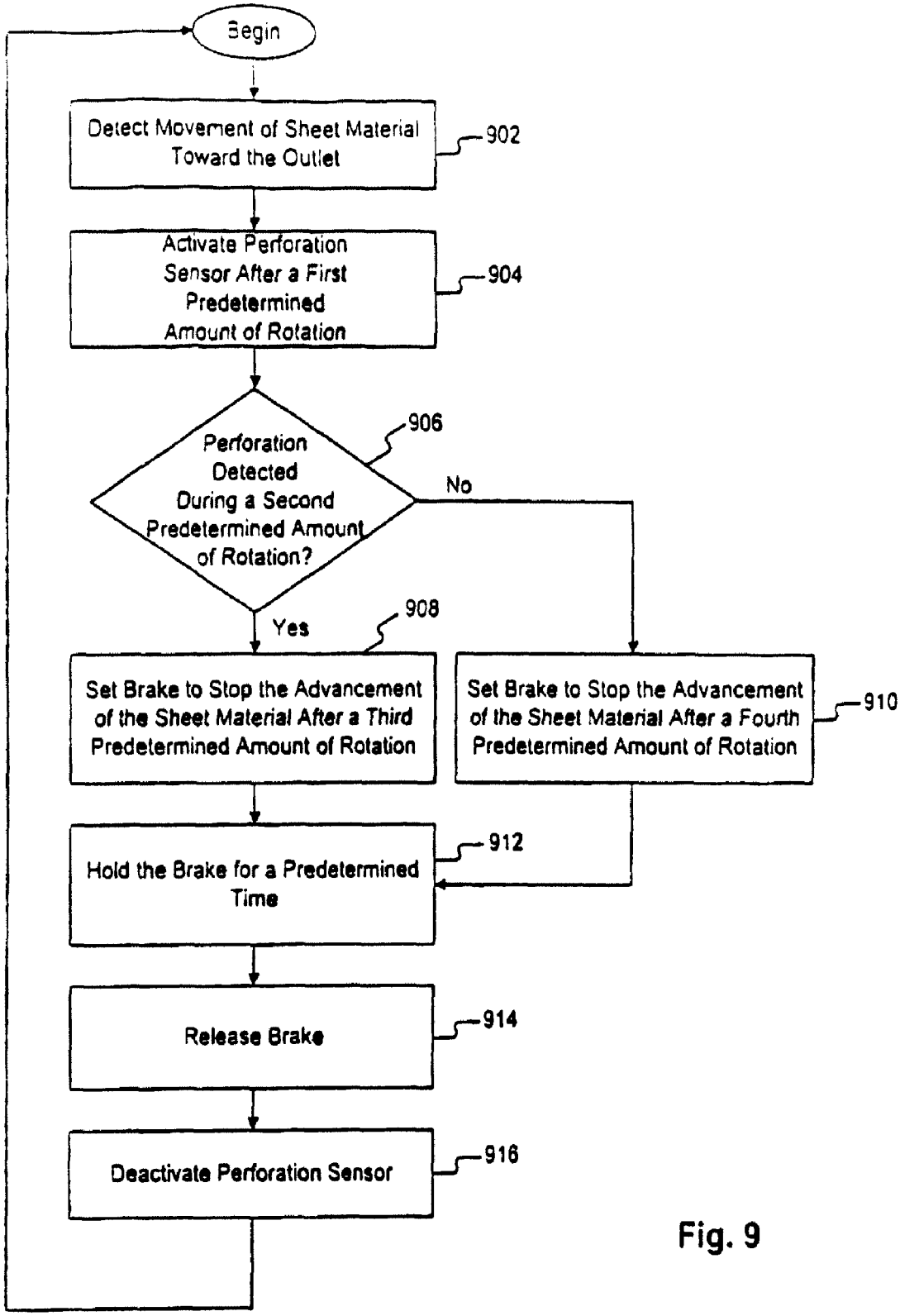
FIG. 9 is a flow chart depicting aspects of a process performed for dispensing sheet material.

FIG. 9 depicts a flow chart of the steps performed by the controller in order to dispense sheet material. The first step is performed when controller 28 detects via counter 68 movement of sheet material 21, which occurs in response to a tugging force applied by a user attempting to dispense sheet material (step 902). Upon detection of this movement, the controller activates perforation sensor 22 (including light emitter 86) after a first predetermined amount of rotation of the dispensing roller (step 904). The predetermined amount of rotation, as referred to in describing the steps performed by the controller, refers to a predetermined number of counts generated by counter 68. This delay is designed to conserve energy such that the perforation sensor may function for longer periods of time without needing, for example, frequent battery replacements.

Once the perforation sensor is activated, the controller determines whether the perforation sensor has detected a perforation while the dispensing roller rotates a second predetermined amount of rotation (step 906). The second predetermined amount of rotation ensures that the perforation sensor will have a sufficient window of time to detect a perforation. If a perforation is detected during the time period corresponding to the second predetermined amount of rotation, the controller issues a command to brake assembly 24 to set the brake and stop the advancement of the sheet material after a third predetermined amount of rotation (step 908). The third predetermined amount of rotation is set to ensure that when the brake is actuated and tearing along the perforations commences, the tail end of the sheet material extending from the outlet of the towel dispenser will have a length sufficient to allow it to be grasped by the next user. If, however, a perforation is not detected during the time period corresponding to the second predetermined amount of rotation, the controller issues a command to brake assembly 24 to set the brake and stop the advancement of the roll of sheet material after a fourth predetermined amount of rotation (step 910). The fourth predetermined amount of rotation is based on the length of each individual sheet separated by the perforations. In one embodiment, the fourth predetermined amount of rotation is determined by controller 28 in response to counts received from counter 68. This aspect of the present invention acts as a backup feature to ensure that the brake is set and that the advancement of the sheet material is stopped even if the perforation sensor fails to detect a perforation for some reason.

One skilled in the art will appreciate that even though, as described above, the controller uses the rotation monitor to determine the length of sheet material passing toward the dispenser outlet, other mechanisms or methods may be used. For example, one may measure the linear displacement of sheet material directly.

After the brake is applied, the controller issues a command to the brake assembly to hold the brake for a predetermined time (step 912). This ensures that the user has enough time to apply a pulling or tugging force to the sheet material and tear an individual segment of the material. The controller then issues a command to the brake assembly to release the brake (step 914). In addition, the controller deactivates the perforation sensor and light emitter to conserve energy (step 916).

To load the dispenser 10, the sheet material source 20 is placed into the pair of support members 40, 42. A tail end 36 of an individual sheet 34 of the sheet material 21 is placed over a portion of the nib roller 16. The tail end 36 is fed into the nip between the nib roller 20 and dispensing roller 18. After passing in the nip, the sheet material 21 is fed between the housing 80 and the light emitter 86. The sheet material 21 contacts the light emitter 86, such that the light emitter 86 spreads perforations 32 as the individual sheets 34 are dispensed. The tail end 36 is fed out through the outlet 14 and extends approximately 2 inches from the outlet to place the dispenser 10 in a condition ready for dispensing.

Figure 10:
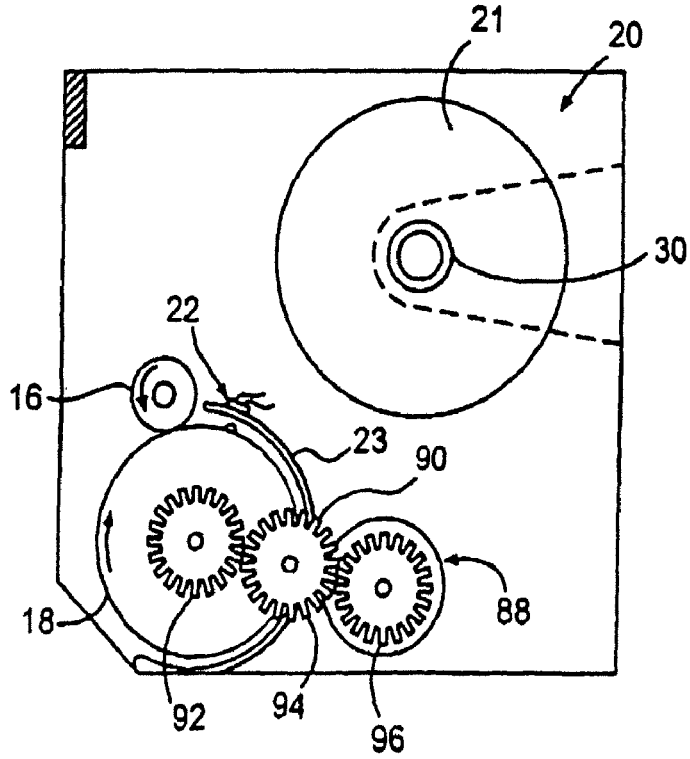
FIG. 10 is another embodiment of the present invention.

FIG. 10 shows another embodiment including a motor drive assembly rather than the solenoid brake assembly. The motor drive assembly includes a gear train 90 and an electric drive motor 88. The gear train 90 includes a first gear 92, a second gear 94, and a drive gear 96. The drive gear 96 is coupled to the motor 88 and engages the second gear 94. The second gear 94 engages the first gear 92, which is coupled to the dispensing roller 18. The motor 88 is activated by a user activating any known switch, such as a push button, proximity sensor, light sensor, etc. (not shown). The motor 88 rotates the drive gear 96, which in turn rotates the second gear 94, which in turn rotates the first gear 92, which in turn causes the dispensing roller 18 to rotate.

Once the motor is activated, the controller detects the advancement of the sheet material via the rotational monitor. The process proceeds in a manner similar to that shown in FIG. 9, but using control of the motor 88 rather than control of a brake. The controller allows movement of sheet material toward the outlet until either the dispensing roller rotates a predetermined amount or a perforation is detected, or a perforation should have been detected. At this point, the controller sends a signal to the motor to stop feeding of the sheet material. In this embodiment, the controller stops the sheet material feeding such that the perforations are in the proper location shortly inside the paper exit. This allows a user to remove a single sheet without exposing a new sheet outside of the dispenser.

Other embodiments of the invention will be apparent to those skilled in the art from consideration of the specification and practice of the invention disclosed herein. For example, the perforation sensor could be eliminated, so that only a rotational monitor could be used to collect information regarding the dispensing of the sheet material. It is intended that the specification and examples be considered as exemplary only, with a true scope and spirit of the invention being indicated by the following claims.

What is claimed is:

1. A dispenser for dispensing sheet material, the dispenser comprising:

a housing defining an interior for accommodating a source of the sheet material, and an outlet through which the sheet material is dispensed:

at least one rotatable roller in the housing, at least a portion of the sheet material being in contact with the roller when the sheet material travels from the source to the outlet;

a brake configured to brake rotational movement of the roller, and a controller configured to selectively activate the brake; and a rotation monitor configured to monitor the amount of rotation of the roller to thereby determine the amount of sheet material traveling downstream from the roller, wherein the rotation monitor comprises a first portion and a second portion, the first portion being configured to move in response to rotation of the roller and the second portion being configured to contact the first portion and provide a signal indicative of rotation of the roller;

wherein the roller comprises a rotational shaft, the first portion comprises a first wheel disposed at one end of the rotational shaft, and configured to rotate along with the rotational shaft;

the brake comprises a second wheel disposed at an opposite end of the rotational shaft, and configured to rotate along with the rotational shaft; and the brake further comprises an engaging member configured to engage the second wheel to selectively brake rotation of the roller.

2. The dispenser according to claim 1, wherein:

the engaging member comprises a solenoid comprising a plunger, the plunger being disposed to engage the second wheel to selectively brake rotation of the roller.

3. The dispenser according to claim 2, wherein:

the second wheel comprises a plurality of detents disposed circumferentially around the second wheel; and the plunger being sized to engage a respective one of the plurality of detents selectively brake rotation of the roller.

* * * * *